United States Patent [19]

Donzis

[11] Patent Number: 4,486,901

[45] Date of Patent: Dec. 11, 1984

[54] MULTI-LAYERED, OPEN-CELLED FOAM SHOCK ABSORBING STRUCTURE FOR ATHLETIC EQUIPMENT

[75] Inventor: Byron A. Donzis, Houston, Tex.

[73] Assignee: Houston Protective Equipment, Inc., Houston, Tex.

[21] Appl. No.: 478,681

[22] Filed: Mar. 25, 1983

Related U.S. Application Data

[63] Continuation-in-part of Ser. No. 357,588, Mar. 12, 1982, abandoned.

[51] Int. Cl.[3] ..... A41D 13/00

[52] U.S. Cl. ..... 2/2; 2/22

[58] Field of Search ..... 2/2, 22, DIG. 3; 5/434

[56] References Cited

U.S. PATENT DOCUMENTS

| | | | |
|---|---|---|---|
| 1,602,454 | 10/1926 | Riddell . | |
| 2,635,240 | 4/1953 | Tausch | 2/18 |
| 2,997,100 | 8/1961 | Morris | 5/348 |
| 3,044,075 | 7/1962 | Rawlings | 2/22 |
| 3,248,738 | 5/1966 | Morgan | 2/2 |
| 3,254,883 | 6/1966 | Morgan . | |
| 3,465,364 | 9/1969 | Edelson | 2/22 |
| 3,500,472 | 3/1970 | Castellani | 2/2 |
| 3,507,727 | 4/1970 | Marshack | 5/434 X |
| 3,585,639 | 6/1971 | Enicks | 2/22 |
| 3,609,764 | 10/1971 | Morgan . | |
| 3,675,377 | 7/1972 | Suter . | |
| 3,849,801 | 11/1974 | Holt et al. . | |
| 3,866,241 | 2/1975 | Grant | 2/2 |
| 3,872,511 | 3/1975 | Nichols . | |
| 3,882,547 | 5/1975 | Morgan . | |
| 3,921,222 | 11/1975 | Hollman | 2/2 |
| 3,995,320 | 12/1976 | Zafuto | 2/2 |
| 3,999,220 | 12/1976 | Keltner | 2/413 |
| 4,067,063 | 1/1978 | Ettinger | 2/2 |
| 4,195,362 | 4/1980 | Rolando | 2/2 |
| 4,272,847 | 6/1981 | Buhler | 2/2 |

*Primary Examiner*—Louis K. Rimrodt

*Attorney, Agent, or Firm*—Arnold, White & Durkee

[57] ABSTRACT

Shock absorbing structure for athletic equipment is disclosed in which a flexible air-tight fabric structure has an internal surface defining a cavity and an external surface adapted to be in fluid communication with the atmosphere outside the shock absorbing structure. The fabric structure includes a plurality of selectively dimensioned and disposed apertures which couple the cavity and the external surface of the shock absorbing structure in continuous fluid communication. A flexible foam portion having an open-celled structure defining a reservoir to releasably hold air is disposed in the cavity of the fabric structure and bonded, at least in part, to at least a portion of the internal surface of the fabric structure. In one embodiment, the flexible foam portion includes a multi-layered laminate of at least three open-celled foams of different foam density. The shock absorbing structure further includes shield structure to distribute the applied force across at least a portion of the fabric covered foam laminate.

9 Claims, 13 Drawing Figures

Fig. 3
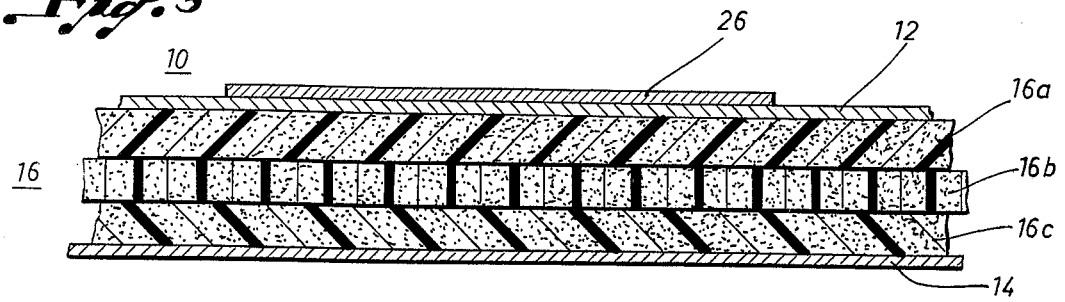
Fig. 4
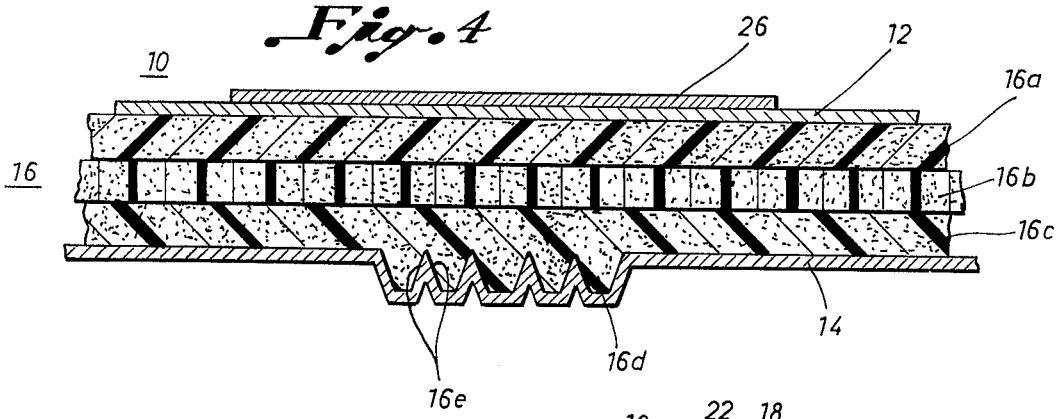
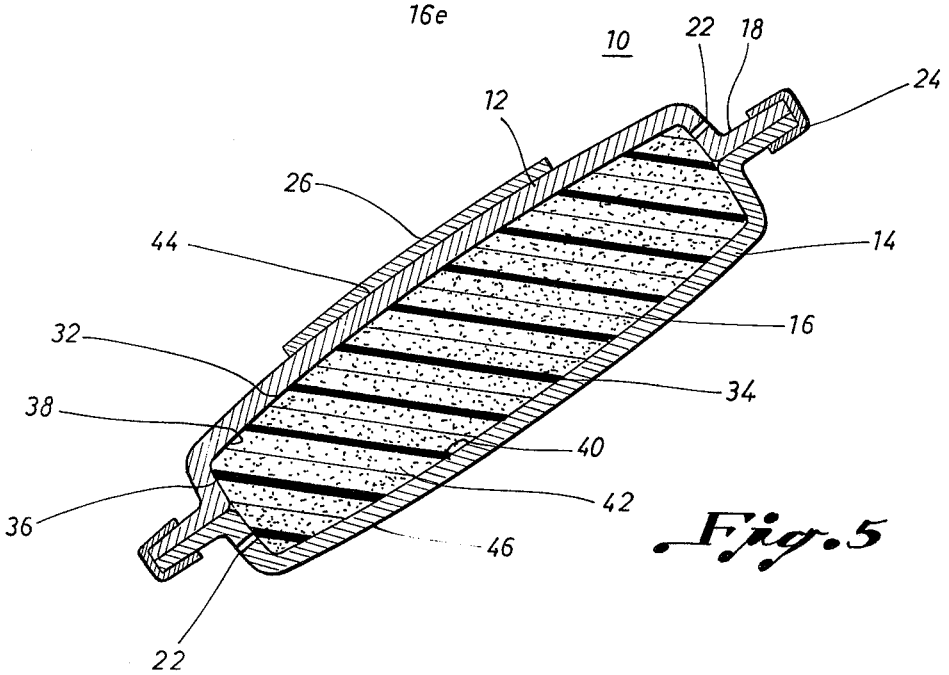
Fig. 5

FIG.6a
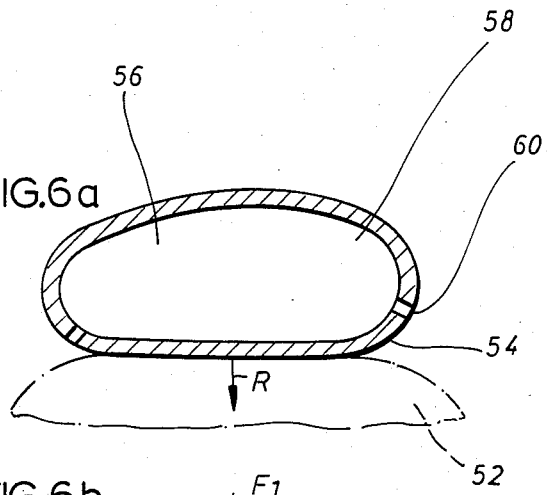
FIG.6b
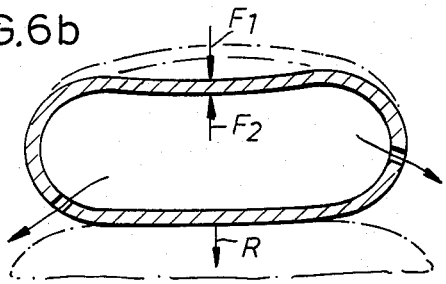
FIG.6c
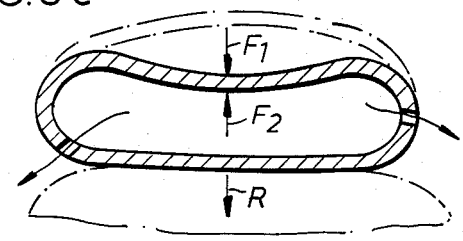
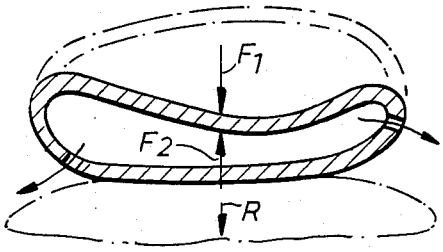
FIG.6d
FIG.6e
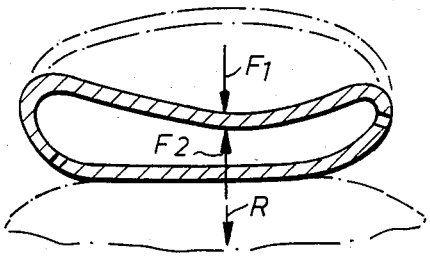
FIG.6f
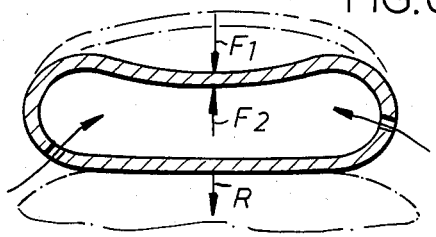
FIG.6g
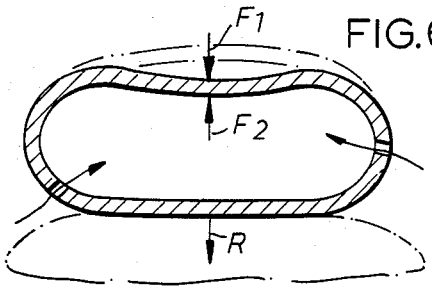
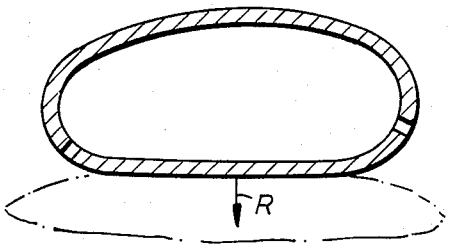
FIG.6h

MULTI-LAYERED, OPEN-CELLED FOAM SHOCK ABSORBING STRUCTURE FOR ATHLETIC EQUIPMENT

CROSS-REFERENCE TO RELATED APPLICATIONS

This patent application is a continuation-in-part of my earlier application, Ser. No. 357,588, filed on Mar. 12, 1982, for Protective Shock Absorbing Equipment, now abandoned.

BACKGROUND OF THE INVENTION

This invention relates to shock absorbing equipment, and more particularly to protective shock absorbing athletic equipment for wear during contact sports, and to methods for making such equipment.

Shock absorbing equipment has long been known and used where shock attenuation is required. For example, to reduce the trauma inflicted upon people in vehicle collisions, closed-cell foam materials have been used in automobile dash boards, sand-filled barrels have been deployed about highway obstructions, and air-bags that inflate upon vehicle impact have been used in passenger compartments. Raw cotton and wool batting have been used for padding and packaging needs, and both batting and inflatable members have been used in clothing and athletic equipment.

Athletic equipment, such as shoulder pads, rib protectors, hip pads, thigh pads, and so forth, are commonly worn by participants in a great variety of sports in which body contact with either another participant or with a piece of equipment used in the sport presents the risk of injury. Such equipment has long been known and used by athletes in contact sports such as football, hockey and so forth.

One type of known prior art athletic equipment includes a relatively hard outer shell of leather, vulcanized fiber, or similar material, and an inner layer of soft padding material. So constructed, the hard outer layer receives the applied force or shock and serves to spread the force over a large area where it is absorbed and cushioned by the soft padding material. Known prior art padding materials include cotton padding, foam rubber, foam plastic material, sponge rubber, expanded rubber or vinyl and the like, with the resilience of such material tending to absorb a portion of the applied force.

Another known type of athletic equipment includes an inflatable balloon-like structure which is inflated with air to a pressure above one atmosphere and then sealed to maintain the air within the structure. When a force is imparted to such a structure, a portion of the air volume within the structure immediately adjacent the point of contact on the structure is forced to another region within the structure causing the entire structure to balloon. This ballooning effect tends to redistribute the applied force in the same manner that stepping on one end of an elongated balloon redistributes the applied force to the other end of the balloon causing the other end to bulge.

The known prior art shock absorbing equipment, however, does not effectively reduce the force actually imparted to the user to a negligible value.

SUMMARY OF THE INVENTION

According to the present invention, shock absorbing structure for athletic equipment is provided for controlled shock attenuation. While the present invention has many applications, it will generally be described with reference to athletic equipment. It will be apparent to those skilled in the art that the present teachings may advantageously be employed in other applications where controlled shock attenuation is required.

The present invention utilizes a controlled transfer of air between an interior region and the atmosphere outside the piece of shock absorbing equipment to present the force inflicted upon the equipment with an oppositely directed force of substantially equal magnitude to impart to the wearer a substantially negligible resultant force.

According to one embodiment of the present invention, a flexible open-celled foam portion is covered with a fabric. The fabric is generally air impermeable, but has a plurality of air permeable regions selectively distributed. The air permeable regions produce continuous fluid communication between the foam portion inside the fabric covering and the atmosphere outside. Upon application of a force to the fabric covering, a portion of the volume of air contained within the cell structure of the foam is selectively transferred through the air permeable regions of the fabric covering to the outside of the covering. The rate of transfer is controlled such that the inflicted force is met with a resistance of substantially equal magnitude and opposite direction to produce a resultant force of substantially negligible magnitude for infliction upon the wearer. Shield structure is included to distribute the force across the fabric covered foam.

According to one aspect of the present invention, the flexible open-celled foam portion includes a multi-layered laminate of open-celled foams having different foam densities. In one embodiment of the present invention, the laminate includes at least three foam layers. In another embodiment, the laminate includes a plurality of foam layers disposed adjacent an inflatable-deflatable structural element.

According to another aspect of the present invention, a method for making shock absorbing structure for athletic equipment includes cutting open-celled foam into a desired pattern, bonding an air-tight fabric to the foam to form an air-tight enclosure about the foam, and inflicting a plurality of holes in the fabric at predetermined locations such that the holes penetrate through the fabric and into the cell structure of the foam.

BRIEF DESCRIPTION OF THE DRAWINGS

The invention will further be described with reference to the accompanying drawings which illustrate shock absorbing structure for athletic equipment in accordance with the present invention, wherein like members bear like reference numerals and wherein:

FIG. 3 is a section view through the shoulder pad illustrated in FIG. 2 along the line 3—3, with the structure layed substantially flat;

FIG. 4 is an alternate embodiment of the structure illustrated in FIG. 3;

FIG. 5 is a schematic cross-section view of shock absorbing structure according to the present invention; and FIGS. 6a–6h are schematic illustrations of the effects of a force $F_1$ upon shock absorbing structure according to the present invention.

DESCRIPTION OF THE PREFERRED EMBODIMENTS

Figure 1:
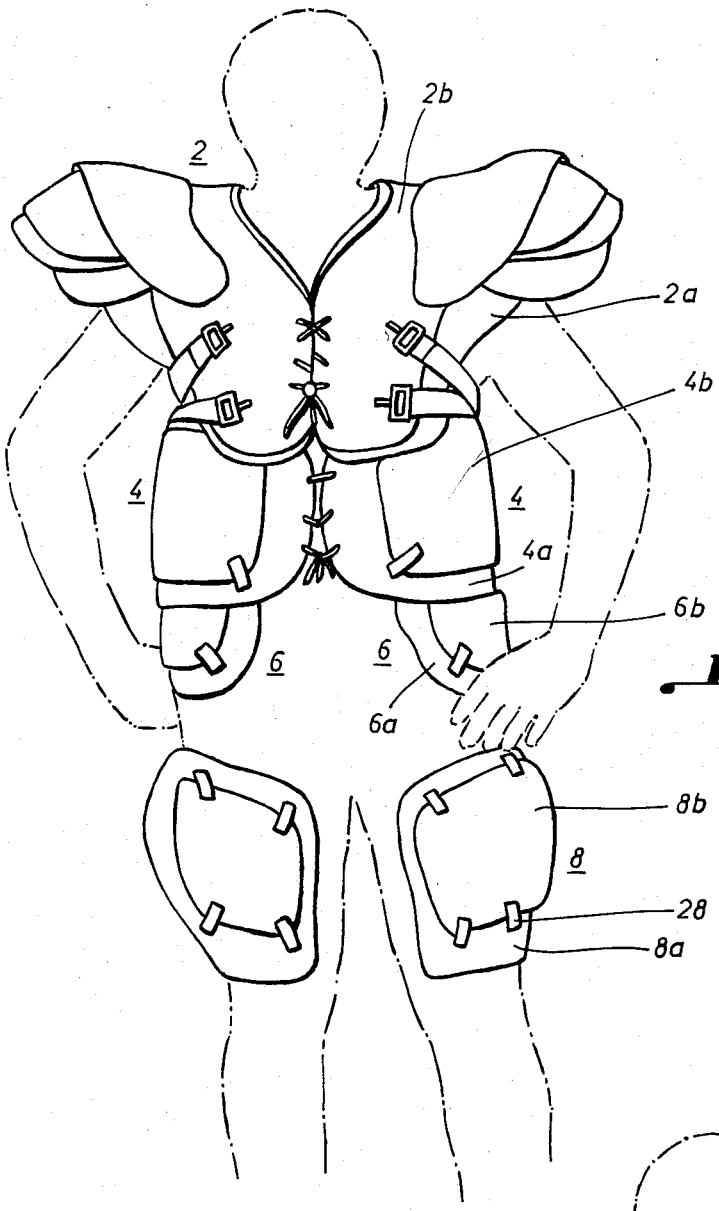
FIG. 1 is a perspective view of football shoulder pads, a rib protector, hip pads and thigh pads in accordance with the present invention.
Figure 2:
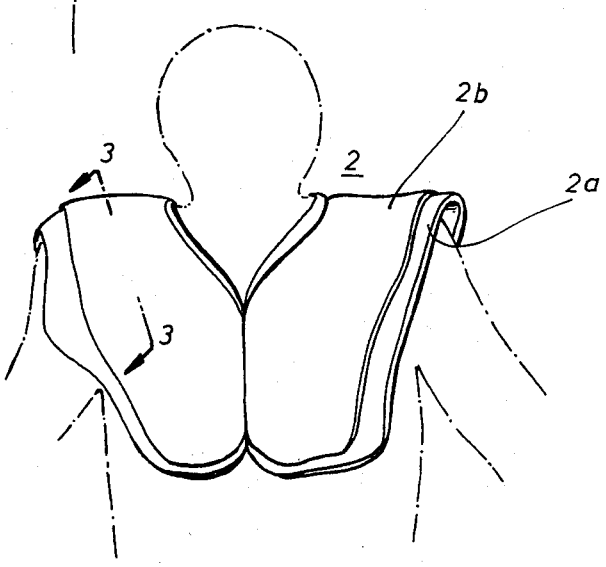
FIG. 2 is a perspective view of a portion of the shoulder pads illustrated in FIG. 1.

Referring now to the drawings, and in particular to FIGS. 1 and 2, protective athletic equipment having shock absorbing structure include shoulder pads 2, a rib protector 4, hip pads 6, and thigh pads 8. Each piece of equipment includes a fabric covered foam portion ( 2a, 4a, 6a, 8a) disposed against the body of the wearer, and a shield structure (2b, 4b, 6b, 8b) to distribute an applied force across at least a portion of the fabric covered foam portion.

The shoulder pads 2, the rib protector 4, the hip pads 6 and the thigh pads 8 each have essentially the same shock absorbing structure in accordance with the present invention, and each are constructed in essentially the same manner. Therefore, for sake of brevity, only the shoulder pads 2 will be described in detail.

The shoulder pads illustrated in FIG. 1 include numerous shield structures and fabric covered foam portions. For sake of clarity, attention will be directed to a pair of shoulder pads 2 having only a fabric covered foam portion 2a and a shield structure 2b collectively referred to herein as the shock absorbing structure 10. Such a pair of shoulder pads is illustrated in FIG. 2 in perspective view and in FIG. 3 in cross section view along the line 3—3 of FIG. 2. As illustrated in FIG. 3, the shock absorbing structure 10 has been unfolded from its position about the shoulder of the wearer and layed substantially flat.

FIG. 5 illustrates schematically in cross section the shock absorbing structure 10 according to the present invention. Referring now to FIG. 5, the shock absorbing structure 10 includes first and second pieces of fabric 12 and 14 disposed about a foam portion 16. The fabric is a nylon material that is rendered relatively air-tight by the inclusion of a polyurethane coating on the face of the fabric disposed adjacent the foam portion 16. The fabric pieces 12 and 14 are bonded to each other along an edge 18 to form an air-tight enclosure about the foam portion 16.

A plurality of apertures 22 are included in the fabric pieces 12 and 14 along the edge 18. The apertures 22 penetrate through the fabric causing the interior of the fabric enclosure housing the foam portion 16 to be in continuous fluid communication with the atmosphere outside the structure 10.

A binding tape 24 is placed about the edge 18 and sewn in place. Attachment of the tape 24 increases the mechanical strength of the edge 18 and enhances the appearance of the structure 10.

One or more shield elements 26 of a semi-rigid plastic or other suitable material, such as the thermalplastic carbonate-linked polymer sold under the name LEXAN, may be affixed by suitable means to the structure 10 to distribute a force inflicted on the structure 10 over a large surface area of the fabric enclosed foam portion. As illustrated in FIG. 1, the shield element 26 is removably connected to the thigh pad 8 by releasable mating hook and loop fastening structure 28, for example, the hook and loop structure sold under the name VELCRO. In an alternate embodiment (not illustrated) the shield element 26 is attached to the fabric enclosed foam portion by rivets.

The plastic material of the shield element 26, for example the shield structure 8b illustrated in FIG. 1, is cut into a desired pattern and then shaped by heating or any other suitable process so that when attached to the fabric covered foam portion 8a of the thigh pad 8, the resulting thigh pad 8 has a desired contour adapted to engage the thigh of the wearer.

The shield element 26 may have a layer of open-celled material, such as polyolefin foam, bonded to its outer surface. Such a foam layer (not illustrated) tends to reduce the likelihood of injury to opponent players who inflict a force upon the shield element 26. Moreover, the foam layer tends to facilitate distributing the inflicted force over a relatively large surface area of the shock absorbing structure 10. Preferably, the thickness of the foam layer is approximately one-half to twice that of the shield element 26.

Referring again to FIG. 5, the foam portion 16 includes a first face 32, a second face 34, and a peripheral edge 36. The fabric pieces 12, 14 include coated faces 38, 40 defining a cavity 42 and uncoated faces 44, 46 in communication with the atmosphere outside the shock absorbing structure 10.

The first and second faces 32 and 34 of the foam portion 16 are bonded to the coated fabric faces 38 and 40, respectively, to form a laminate which permits adjacent fabric/foam faces to move as a unit. When a nylon fabric having a polyurethane coating is used, the fabric pieces may be bonded to the foam portion by adheringly applying the fabric pieces to the foam portion, such as by heat sealing. When a nylon fabric having a polyurethane coating is not used, the fabric may be coated if desired and then bonded to the foam portion in any suitable mannner, such that the enclosure or cavity 42 formed by the fabric is substantially air-tight and the faces of the foam portion are bonded, at least in part, to the inside surface of the cavity.

As will be apparent to those skilled in the art, any suitable method of bonding pieces of relatively air-tight fabric to foam may be employed, such as the use of radio frequency induction heating techniques, the use of adhesive materials, and so forth. Alternatively, pieces of fabric that are not relatively air-tight may be bonded to the foam portion such that a substantially air-tight enclosure is formed.

The peripheral edge 36 of the foam portion 16 may also be bonded to the faces 38 and 40 of the fabric pieces 12 and 14. While such bonding is not necessary, it further enhances control over the transfer of air between the cellular structure of the foam portion inside the enclosure and the atmosphere outside the enclosure.

The foam portion 16 is an open-celled material such as polyurethane foam. It may be a reticulated foam, that is, a foam which has been fire polished to destroy the membranes or thin films joining the strands which divide continguous cells without destroying the strands of the skeletal structure or which has been treated chemically to destroy the strands, or any other suitable material having an open-celled structure. The cellular structure of the foam portion 16, which is in fluid communication with the atmosphere outside of the enclosure or cavity 42 by way of the apertures 22, constitutes a reservoir inside the cavity which releasably holds air.

Referring again to FIG. 3, the foam portion 16 is illustrated in greater detail. The foam portion 16 is a multi-layered laminate having foam layers 16a, 16b and 16c. As illustrated, the foam layer 16a is disposed adjacent the first piece of fabric 12, the foam layer 16c is disposed adjacent the second piece of fabric 14, and the foam layer 16b is disposed between the foam layers 16a and 16c.

Each foam layer 16a, 16b and 16c have a different foam density. The density of the foam layer 16c, which is designed to be disposed adjacent the body of the wearer, has the lowest foam density. Its foam density should be no more than approximately one pound per cubic foot. The preferred range of densities is between one-half and three-quarter pound per cubic foot.

Soft foam is used in foam layer 16c to enhance comfort levels and provide proper fit. Since the structure 10 must be shaped to conform to the body of the wearer, the foam layer 16c must have sufficient softness to conform to the contour of the body while providing good body contact.

To further enhance fit and comfort, an alternate embodiment illustrated in FIG. 4 includes a foam layer 16c having a plurality of regions 16d of varied height. In operation, as the structure 10 is fitted about the body, sides 16e of the height-varied regions 16d move closer together and tend to form a firmer fit than the structure illustrated in FIG. 3.

Referring once again to FIG. 3, the outer foam layer 16a has a relatively high foam density. The density range is from approximately 3 pounds per cubic foot to 16 pounds per cubic foot or more. The preferred range is approximately 3 to 4 pounds per cubic foot.

The foam layer 16b sandwiched between the high density outer foam layers 16a and the low density inner foam layer 16c has an intermediate density between the densities of the inner and outer foam layers. The preferred density of the foam layer 16b is approximately 2 pounds per cubic foot.

The foam portion 16 in the illustrated embodiment has three foam densities by virtue of having three foam members, 16a, 16b and 16c. More than three foam members may be used. It is important that the foam layer closest the body have a low enough density for enhanced comfort and fit, and the density of the layer furthest from the body be sufficiently great so that the shock absorbing structure 10 adequately absorbs the inflicted force.

In alternate embodiments (not illustrated) an inflatable-deflatable structural element is used in place of either foam layer 16a or foam layer 16c. The foam portion 16 in these alternate embodiments is a multi-layered laminate of a plurality of open-celled foams having different foam densities, and the inflatable-deflatable structural element is disposed adjacent the multi-layered foam laminate. The inflatable-deflatable structural element includes an inflatable-deflatable chamber, and may include open-celled foam disposed within the chamber.

Referring now to FIG. 6a, a schematically illustrated shock absorbing structure 10 disposed adjacent a wearer 52 includes an air-tight fabric enclosure 54 having a cavity 56. Flexible open-celled foam portion 58 is disposed within the cavity 56 such that the outer surface of the foam portion is bonded to the inner surface of the cavity. A plurality of apertures 60 are included in the air-tight fabric enclosure 54 and provide continuous fluid communication between the cavity 56 and the atmosphere outside the shock absorbing structure 10.

Referring to FIG. 6a, in the absence of an external force inflicted upon the shock absorbing structure 10, the cells of the foam portion 58 in the cavity 56 contain a first volume of air at one atmosphere of pressure. The pressure within and without the shock absorbing structure 10 is the same because apertures 60 reduce the pressure differential across the portion of the fabric enclosure 54 containing the air-permeable apertures 60 to a quiescent value of zero. Since the inflicted external force is zero, the resulted force R transmitted to the wearer 52 is also zero.

Referring now to FIG. 6b, a force $F_1$ is inflicted upon the shock absorbing structure 10. In the absence of the apertures 60, the inflicted force may tend to distort the shape of the cavity 56, but it cannot alter the volume of air contained within the cavity 56 because air is essentially an incompressible fluid. On the other hand, if the apertures 60 were uncontrollably large, the inflicted force $F_1$ would tend to collapse the structure 10 expelling the air contained within the cellular structure of the foam portion 58 through the aperture 60. In either case, a significant portion of the inflicted force would likely be imparted to the wearer. Controlled expulsion of the air contained in the cellular structure, however, reduces the resultant force imparted to the wearer to substantially zero.

As the force $F_1$ is inflicted upon the shock absorbing structure 10, a portion of the air contained in the cellular structure of the foam portion 58 is transferred from the cavity 56, through the apertures 60, and into the atmosphere outside the structure 10. The volume of air transferred per unit of time, which is determined by the size and number of the apertures 60, is chosen to create a back pressure in the cavity 56 which presents the inflicted force $F_1$ with a force $F_2$ of equal magnitude and opposite direction. The forces $F_1$ and $F_2$ vectorially add such that the resultant force R imparted to the wearer 52 is essentially zero.

The force $F_1$ exists for some finite period of time and thus can be viewed as increasing in magnitude from zero to some maximum value, dwelling at that maximum value for some finite period of time, and then decreasing from that maximum value to zero. FIGS. 6b, 6c and 6d schematically illustrate the behavior of the shock absorbing structure 10 as the inflicted force increases to its maximum value.

As the magnitude of the force increases, the pressure within the cavity 56 increases to a value above one atmosphere and air within the cellular structure of the foam portion 58 is expelled through the apertures 60. Both the air pressure in the cavity and the volume of the cavity decrease.

As the force $F_1$ reaches its maximum value, the rate of change of $F_1$ per unit of time reaches zero. Therefore, the rate of change of cavity volume per unit of time and the volume of air expelled from the cavity per unit of time also reach zero. This is depicted in FIG. 6e.

The inflicted force $F_1$ then decreases in magnitude from the maximum value to zero, and the elasticity of the foam portion 58 causes the cavity 56 to increase in volume. As the volume increases, air is drawn through the apertures 60 and into the cavity 56 from the atmosphere outside the shock absorbing structure 10. This is schematically illustrated in FIGS. 6f and 6g. The rate at which air is drawn into the cavity 56 and thus the rate at which the volume of the cavity increases, is again determined by the number and size of the apertures 60 and is chosen such that the forces $F_1$ and $F_2$ add vectorially to produce a resultant force R of substantially zero magnitude.

After the magnitude of the inflicted force $F_1$ has decreased to zero, the cavity 56 returns to its initial volume as illustrated in FIG. 6*h*, which depicts a condition identical to that of FIG. 6*a*. In this quiescent condition, the pressure within and without the cavity 56 is at one atmosphere.

According to the present invention, shock absorbing structure 10 is made by bonding together a plurality of open-celled foam layers having different foam densities to form a laminate, and cutting the laminate to a desired pattern. Alternatively, a plurality of foam layers may each be cut to a desired pattern, and then the cut members bonded together to form a laminate. In either case, the laminated foam member has first and second faces and a peripheral edge. A piece of air-tight fabric is bonded to each face of the foam member, and then the two pieces of fabric are bonded to each other adjacent the peripheral edge of the foam member. A plurality of holes are then inflicted into the fabric adjacent the peripheral edge of the foam member. The holes penetrate through the fabric and through the peripheral edge of the foam member to provide continuous fluid communication between the open-celled structure of the foam and the atmosphere outside the shock absorbing structure 10. The holes are dimensioned and spaced one from the other to give the shock absorbing structure 10 a predetermined responsiveness to a given inflicted force.

In making relatively large shock absorbing structures, such as shin guards for use in hockey, the two pieces of air-tight fabric may be bonded to each other such that the inner face of one is bonded to the outer face of the other. In other shock absorbing structures, such as thigh pads, the two pieces of fabric have their inner faces bonded to one another, thereby forming the edge 18 best illustrated in FIG. 5. When such an edge is formed, the edge is trimmed and a binding tape 24 placed about the edge and sewn in place.

The shield element 26 is then cut and formed to the desired shape, and attached to the fabric covered foam member. Preferably, the shield member is releasably attached using hook and loop fastening structure, or any other suitable releasable structure. It may, however, be fixedly attached by sewing, riveting, or in any other suitable manner.

The inflatable-deflatable structural element may be similar to those described in U.S. Pat. Nos. 3,675,377 and 3,866,241, which are hereby incorporated by reference.

The air permeable regions selectively distributed in the generally air impermeable fabric for controlled continuous fluid communication between the foam portion enclosed by the fabric and the atmosphere outside need not be apertures. Any suitable structure may be used which provides such controlled continuous fluid communication. For example, one or more discrete valve members may be used. Valve members which permit fluid flow in only one direction may also be used, provided the unidirectional valve members are disposed such that at least one permits air to flow into the enclosure and at least one permits air to flow out of the enclosure.

The shield elements need not be made of semi-rigid plastic. Any suitable structure which distributes the inflicted force over a relatively large surface area may be used. Additionally, shield elements may be included within the fabric enclosed foam laminate.

The principles, preferred embodiments and modes of operation of the present invention have been described in the foregoing specification. The invention is not to be construed as limited to the particular forms disclosed, since these are regarded as illustrative rather than restrictive. Moreover, variations and changes may be made by those skilled in the art without departing from the spirit of the invention.

What is claimed is:

1. Shock absorbing structure for athletic equipment to protect a wearer from infliction of an externally applied force, comprising:

a flexible enclosure having first and second faces and a periphery defining a cavity, said first and second faces being air impermeable and said periphery having at least one air impermeable region and at least one air permeable region such that said cavity is in continuous fluid communication with the atmosphere outside the shock absorbing structure;

a flexible open-celled foam portion comprising a multi-layered laminate of at least three open-celled foams of different foam density including inner, outer and intermediate foam layers each having two faces, one face of said intermediate foam layer being bonded to one face of said inner foam layer and the other face of said intermediate foam layer being bonded to one face of said outer foam layer, said foam portion having first and second faces disposed adjacent to and bonded at least in part to said first and second faces, respectively, of the flexible enclosure, and having a periphery disposed adjacent said periphery of the flexible enclosure, the cells of said foam portion releasably holding a volume of air selectively varied between first and second volumes differing by a volume differential in response to application and removal of the force on the shock absorbing structure, said volume differential being transferred between the foam portion and the atmosphere outside the shock absorbing structure through said at least one air permeable region of the periphery of the flexible enclosure; and shield structure disposed outside said flexible enclosure adjacent the face of the multi-layered laminate having the highest foam density to distribute the applied force across at least a portion of said face.

2. The shock absorbing structure of claim 1 wherein said shield structure comprises:

at least one semi-rigid shield element removably attached to said flexible enclosure; and hook and loop fastening structure to removably attached said shield structure to said flexible enclosure.

3. The shock absorbing structure of claim 1:

wherein said flexible enclosure comprises a nylon fabric having a polyurethane coating on one face, said flexible open-celled foam portion comprises polyurethane foam, and the coated face of the fabric is heat sealed at least in part to the polyurethane foam portion;

wherein said inner foam layer comprises a foam having a density in the range of approximately one pound per cubic foot and below;

wherein said outer foam layer comprises a foam having a density in the range of approximately three pounds per cubic foot and greater; and wherein said intermediate foam layer comprises a foam having a density intermediate the foam densities of said inner and outer foam layers.

4. The shock absorbing structure of claim 3 wherein:

said inner foam layer has a foam density in the range of approximately one-half to three-quarter pound per cubic foot;

said outer foam layer has a foam density in the range of approximately three to four pounds per cubic foot; and said intermediate foam layer has a foam density of approximately two pounds per cubic foot.

5. The shock absorbing structure of claim 1 wherein the open-celled foam layer of the foam portion adapted to be disposed adjacent the wearer comprises a plurality of height-varied regions adapted to conform to a body contour of said wearer.

6. Shock absorbing structure for athletic equipment to protect a wearer from infliction of an externally applied force, comprising:

a flexible enclosure having first and second faces and a periphery defining a cavity, said first and second faces being air impermeable and said periphery having at least one air impermeable region and at least one air permeable region such that said cavity is in continuous fluid communication with the atmosphere outside the shock absorbing structure;

a member having first and second faces disposed adjacent to and bonded at least in part to said first and second faces, respectively, of the flexible enclosure, said member including:

an inflatable-deflatable structural element; and a flexible open-celled foam portion disposed adjacent said inflatable-deflatable structural element and comprising a multi-layered laminate of open-celled foams of different foam density including first and second foam layers each having two faces, one face of said first foam layer being bonded to one face of said second foam layer, the cells of said foam portion releasably holding a volume of air selectively varied between first and second volumes differing by a volume differential in response to application and removal of the force on the shock absorbing structure, said volume differential being transferred between the foam portion and the atmosphere outside the shock absorbing structure through said at least one air permeable region of the periphery of the flexible enclosure; and shield structure dispoed outside said flexible enclosure and adjacent one of said first and second faces of said flexible enclosure to distribute the applied force across at least a portion of said one of said first and second faces.

7. The shock absorbing structure of claim 6 wherein said inflatable-deflatable structural element includes an open-celled foam member.

8. The shock absorbing structure of claim 6 wherein said inflatable-deflatable structural element is disposed adjacent said shield structure.

9. The shock absorbing structure of claim 6 wherein one of the open-celled foam layers of the foam portion comprises a plurality of height-varied regions adapted to conform to a body contour of said wearer.

* * * * *

UNITED STATES PATENT AND TRADEMARK OFFICE

CERTIFICATE OF CORRECTION

PATENT NO. : 4,486,901

DATED : December 11, 1984

INVENTOR(S) : Byron A. Donzis

It is certified that error appears in the above-identified patent and that said Letters Patent is hereby corrected as shown below:

Column 5, Line 30, "density outer foam layers 16 a and the low density inner" should read -- density outer foam layer 16a and the low density inner --.

Signed and Sealed this

*Thirtieth* Day of *April 1985*

[SEAL]

*Attest:*

DONALD J. QUIGG

*Attesting Officer*

*Acting Commissioner of Patents and Trademarks*